US009863586B2

(12) United States Patent
Yang et al.

(10) Patent No.: US 9,863,586 B2
(45) Date of Patent: Jan. 9, 2018

(54) LED DISPLAY DEVICE

(71) Applicant: UNILUMIN GROUP CO., LTD., Shenzhen (CN)

(72) Inventors: Kuang Yang, Shenzhen (CN); Mingfeng Lin, Shenzhen (CN); Wei Wang, Shenzhen (CN); Wenrong Li, Shenzhen (CN)

(73) Assignee: UNILUMIN GROUP CO., LTD., Shenzhen (CN)

( * ) Notice: Subject to any disclaimer, the term of this patent is extended or adjusted under 35 U.S.C. 154(b) by 182 days.

(21) Appl. No.: 14/650,504

(22) PCT Filed: Dec. 8, 2014

(86) PCT No.: PCT/CN2014/093306
§ 371 (c)(1),
(2) Date: Jun. 8, 2015

(87) PCT Pub. No.: WO2016/074301
PCT Pub. Date: May 19, 2016

(65) Prior Publication Data

US 2016/0169456 A1 Jun. 16, 2016

(30) Foreign Application Priority Data

Nov. 14, 2014 (CN) ..... 2014 2 0685740 U

(51) Int. Cl.
*F21K 99/00* (2016.01)
*F21V 19/00* (2006.01)
(Continued)

(52) U.S. Cl.
CPC ..... *F21K 9/30* (2013.01); *F21K 9/20* (2016.08); *F21V 19/002* (2013.01);
(Continued)

(58) Field of Classification Search
CPC . F21K 9/30; F21K 9/20; F21V 19/002; F21V 19/003; G09F 9/3026; G09F 9/35
(Continued)

(56) References Cited

U.S. PATENT DOCUMENTS 6,314,669 B1 11/2001 Tucker
2011/0089824 A1* 4/2011 Zheng ..... G09F 9/33 313/512

(Continued)

FOREIGN PATENT DOCUMENTS

CN 101075394 A 11/2007
CN 101499227 A 8/2009

(Continued)

OTHER PUBLICATIONS

International Search Report and English Translation thereof for International Application No. PCT/CN2014/093306, dated Aug. 25, 2015 (8 pages).

(Continued)

*Primary Examiner* — Sean Gramling
*Assistant Examiner* — Gerald J Sufleta, II
(74) *Attorney, Agent, or Firm* — Kagan Binder, PLLC

(57) ABSTRACT

An LED display device includes an installing pillar, a first fixing plate, an enclosure module, an LED display screen module and a first connection member, the enclosure module includes a front surface for display and a rear surface opposite to the front surface, the installing pillar is positioned on the rear surface of the enclosure module, the first fixing plate closely contacts the installing pillar, the first fixing plate defines a first fixing hole, the first connection member extends through the first fixing hole from the rear surface of the enclosure module and connects with the enclosure module, thereby clamping and securing the installing pillar between the first fixing plate and the enclosure module, and the enclosure module is fixed to the installing pillar via the first fixing plate and the first con-
(Continued)

nection member, the LED display screen module is assembled to the front surface of the enclosure module. Thereby the LED display device can be maintained with a high flexibility and it is convenience for operation, and the cost thereof is low, thus a front/rear side-maintenance type assembly can be realized.

7 Claims, 7 Drawing Sheets

(51) Int. Cl.

| | |
|---|---|
| ***G09F 9/302*** | (2006.01) |
| ***G09F 9/35*** | (2006.01) |
| ***F21K 9/20*** | (2016.01) |
| *F21Y 105/10* | (2016.01) |
| *F21Y 115/10* | (2016.01) |

(52) U.S. Cl.
CPC ..... *G09F 9/3026* (2013.01); *G09F 9/35* (2013.01); *F21Y 2105/10* (2016.08); *F21Y 2115/10* (2016.08)

(58) Field of Classification Search
USPC ..... 362/249.02, 217.1, 217.11–217.17, 362/632–634; 40/605
See application file for complete search history.

(56) References Cited

U.S. PATENT DOCUMENTS

| | | | | |
|---|---|---|---|---|
| 2011/0205741 | A1* | 8/2011 | Suzuki | F21V 7/0008 362/294 |
| 2014/0286009 | A1* | 9/2014 | Hamilton | F21V 23/00 362/249.02 |

FOREIGN PATENT DOCUMENTS

| | | | |
|---|---|---|---|
| CN | 101510384 | A | 8/2009 |
| CN | 101789205 | A | 7/2010 |
| CN | 202694705 | U | 1/2013 |
| CN | 203607045 | U | 5/2014 |
| CN | 203631082 | U | 6/2014 |
| KR | 20130117429 | A | 10/2013 |

OTHER PUBLICATIONS

Written Opinion and English Translation thereof for International Application No. PCT/CN2014/093306, dated Aug. 25, 2015 (9 pages).

* cited by examiner

LED DISPLAY DEVICE

FIELD OF THE INVENTION

The present INVENTION relates to a field of display devices, and more particularly relates to an LED display device.

REARGROUND OF THE INVENTION

Based on a fast development of LED display screen industry, more and more new type products appear on the market. Meanwhile, more and more companies tend to employ display screens to display information. Different companies have different requirements of mounting positions for mounting the display screens, such as positions of the display screen to be mounted to the wall or to the roof and so on. At present, most of the display screens on the market adopt iron stands to be fixedly mounted, and adopt a two-in-one hanging beam fixing manner, under such an installing manner, it is troublesome when maintaining an enclosure of the display screen, for example maintaining the display screen in a narrow place.

SUMMARY OF THE INVENTION

Accordingly, it is necessary to aim at the maintenance shortcomings of the LED display screen, and provide an LED display device to facilitate to maintenance.

An LED display device includes an installing pillar, a first fixing plate, an enclosure module, an LED display screen module and a first connection member, the enclosure module includes a front surface for display and a rear surface opposite to the front surface, the installing pillar is positioned on the rear surface of the enclosure module, the first fixing plate closely contacts the installing pillar, the first fixing plate defines a first fixing hole, the first connection member extends through the first fixing hole from the rear surface of the enclosure module and connects with the enclosure module, thereby clamping and securing the installing pillar between the first fixing plate and the enclosure module, and the enclosure module is fixed to the installing pillar via the first fixing plate and the first connection member, the LED display screen module is assembled to the front surface of the enclosure module.

According to one embodiment, the enclosure module comprises an enclosure body defining a mounting hole thereon, the first connection member extends through the first fixing hole and the mounting hole in that order from the rear surface of the enclosure module, thereby connecting the first fixing plate to the enclosure module.

According to one embodiment, the enclosure module comprises a plurality of enclosure bodies, the plurality of enclosure bodies are distributed on a plane and arranged in a lattice array configuration, the first fixing plate defines four first fixing holes, and the enclosure body defines four mounting holes on four corners thereof, on adjacent portions of four enclosure bodies, the four first fixing holes of the first fixing plate respectively corresponds to four mounting holes of every four enclosure bodies, the four mounting holes are located on four gathering corners of the four enclosure bodies, the first connection member secures every four enclosure bodies.

According to one embodiment, the enclosure module comprises an enclosure body, a second fixing plate and a second connection member, the enclosure body defines a mounting hole, the second fixing plate defines a second fixing hole, the second fixing plate is located at the rear surface of the enclosure module and positioned between the installing pillar and the enclosure body, the second connection member extends through the mounting hole and the second fixing hole in that order from the front surface of the enclosure module, thereby connecting the second fixing plate to the enclosure body.

According to one embodiment, the second fixing plate further defines a third fixing hole, the first connection member extends through the first fixing hole and the third fixing hole in that order from the rear surface of the enclosure module, thereby connecting the first fixing plate to the enclosure module.

According to one embodiment, the enclosure module comprises a plurality of enclosure bodies, the plurality of the enclosure bodies are distributed on a plane and arranged in a lattice array configuration, the second fixing plate defines four second fixing holes thereon, on adjacent portions of four enclosure bodies, the four second fixing holes respectively corresponds to four mounting holes of every four enclosure bodies, the four mounting holes are located on four gathering corners of the four enclosure bodies, the second connection member secures every four enclosure bodies.

According to one embodiment, the enclosure body comprises a bounding frame, strip bars, power supply mounting portions, and wire-through grooves, the bounding frame comprises two side border frames on the opposite sides thereof, and two end border frames on opposite ends thereof, the strip bars comprise longitudinal strip bars and horizontal strip bars perpendicular to the longitudinal strip bars, the longitudinal strip bars connect with a side of the bounding frame and are substantially perpendicular to the bounding frame; the power supply mounting portions are positioned on an end of the enclosure body, and the power supply mounting portion defines a slot for receiving a power supply; the wire-through grooves comprises longitudinal wire-through grooves and horizontal wire-through grooves, the longitudinal wire-through groove is fixedly connected to the horizontal strip bar, an end of the wire-through groove cuts through the slot and the other end of the wire-through groove extends to one end border frame on an end of the bounding frame opposite to the power supply mounting portion, the horizontal wire-through grooves are fixedly connected to the longitudinal strip bars, and the horizontal wire-through groove extends between the two side border frames on opposite sides, the longitudinal wire-through grooves and the horizontal wire-through grooves intersect with each other and are poisoned in the bounding frame of the enclosure body, and form channels in intersecting portions of the longitudinal wire-through grooves and the horizontal wire-through grooves.

According to one embodiment, the longitudinal strip bars and the longitudinal wire-through grooves are parallel arranged and spaced from each other, the horizontal strip bars and the horizontal wire-through grooves are parallel arranged and spaced from each other, every longitudinal wire-through groove cuts through the slot.

According to one embodiment, all of the strip bars are arranged in a plane perpendicular to the bounding frame, the wire-through grooves protrude from a same side of the bounding frame, and do not protrude from the plane where the strip bars positioned upon.

According to one embodiment, both of the strip bar and the wire-through groove define a butterfly shaped slot and a positioning hole, the LED display screen module is provided with butterfly shaped hooks, the LED display screen module is secured to the enclosure body via an engagement of the butterfly shaped hooks and the butterfly shaped slots.

The LED display device, includes an installing pillar, a first fixing plate, an enclosure module, an LED display screen module and a first connection member, the enclosure module includes a front surface for display and a rear surface opposite to the front surface, the installing pillar is positioned on the rear surface of the enclosure module, the first fixing plate closely contacts the installing pillar, the first fixing plate defines a first fixing hole, the first connection member extends through the first fixing hole from the rear surface of the enclosure module and connects with the enclosure module, thereby clamping and securing the installing pillar between the first fixing plate and the enclosure module, and the enclosure module is fixed to the installing pillar via the first fixing plate and the first connection member, the LED display screen module is assembled to the front surface of the enclosure module. Thereby the LED display device can be maintained with a high flexibility and it is convenience for operation, and the cost thereof is low, thus a front/rear surface-maintenance type assembly can be realized.

DETAILED DESCRIPTION OF THE EMBODIMENTS

Figure 1:
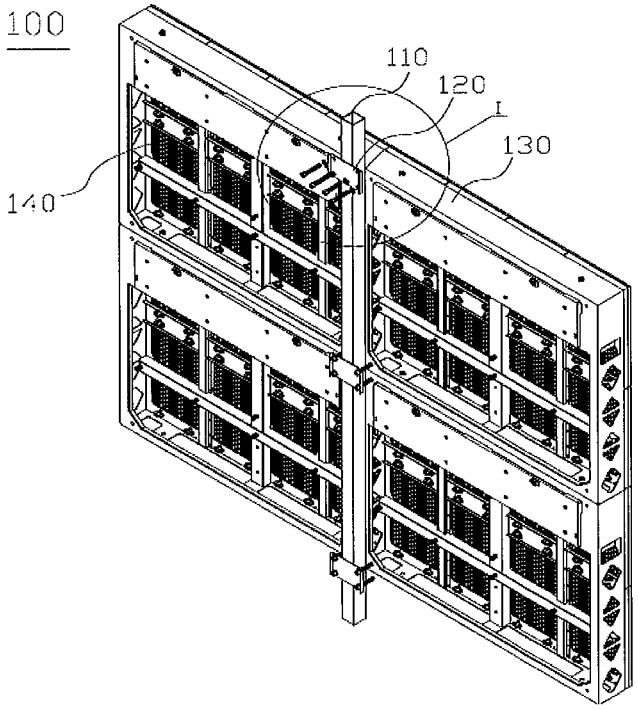
FIG. 1 is an isometric perspective view of an LED display device according to a first embodiment of the present INVENTION.

Embodiments of the INVENTION are described more fully hereinafter with reference to the accompanying drawings. The preferred embodiment of the present INVENTION is given in the drawings. The various embodiments of the INVENTION may, however, be embodied in many different forms and should not be construed as limited to the embodiments set forth herein. Rather, these embodiments are provided so that this disclosure will be thorough and complete, and will fully convey the scope of the INVENTION to those skilled in the art.

Unless otherwise defined, the technical and scientific terms used in this paper has the same meaning as the commonly understood of those skilled in the art. The object of the terms used in the specification of the present INVENTION in this paper is for describing the specific embodiments, instead of limiting the present INVENTION. The term "and/or" used in this paper includes the one or more related items' combinations.

Figure 2:
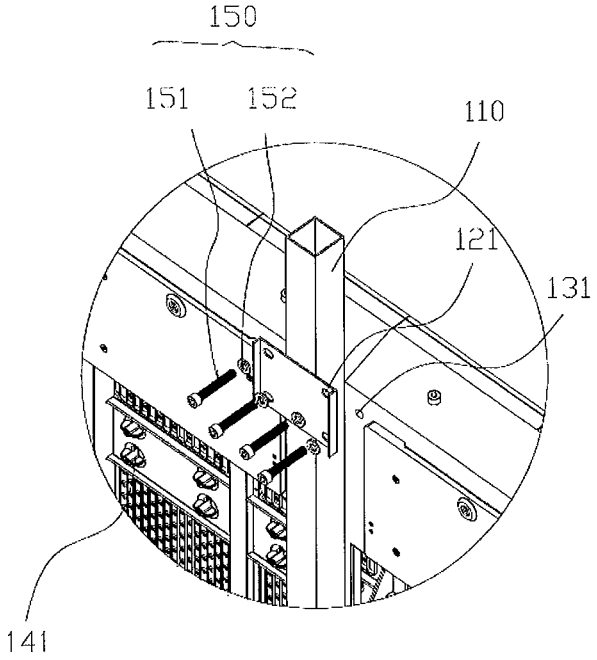
FIG. 2 is a partial enlarged view of portion I of the LED display device of FIG. 1.

Referring to FIGS. 1 through 2, an LED display device 100 according to a first embodiment includes an installing pillar 110, a first fixing plate 120, an enclosure module 130, an LED display screen module 140 and a first connection member 150.

The enclosure module 130 includes a front surface for displaying and a rear surface opposite to the front surface. The installing pillar 110 is positioned on the rear surface of the enclosure module 130. The first fixing plate 120 closely contacts the installing pillar 110, and defines a first fixing hole 121. The first connection member 150 extends through the first fixing hole 121 from the rear surface of the enclosure module 130 and is connected to the enclosure module 130, clamping and securing the installing pillar 110 between the first fixing plate 120 and the enclosure module 130. The enclosure module 130 is fixed to the installing pillar 110 via the first fixing plate 120 and the first connection member 150. The LED display screen module 140 is assembled to the front surface of the enclosure module 130.

The enclosure module 130 includes an enclosure body 13. The enclosure body 13 defines a mounting hole 131 thereon. The first connection member 150 extends through the first fixing hole 121 and the mounting hole 131 in that order from the rear surface of the enclosure module 130, thereby connecting the first fixing plate 120 to the enclosure module 130.

In an embodiment, the enclosure module 130 includes a plurality of enclosure bodies 13, and the plurality of enclosure bodies 13 are distributed on a plane and arranged in a lattice array configuration. The first fixing plate 120 defines four first fixing holes 121. The enclosure body 13 defines four mounting holes 131 on four corners thereof. On adjacent portions of four enclosure bodies 13, the four first fixing holes 121 of the first fixing plate 120 corresponds to four mounting holes 131 of every four enclosure bodies 13, the four mounting holes 131 are located on the four gathering corners of the four enclosure bodies 13. The first connection members 150 secure every four enclosure bodies 13. Thus, on one hand, the four enclosure bodies 13 are secured by the first fixing plate 120. On the other hand, the four gathering corners of every four enclosure bodies 131 are connected by the first connection members 150, securing multiple enclosure bodies 131 to the mounting pillar 110, capable of achieving a free combination and an unrestricted joint of multiple display screen modules 140. Meanwhile, the enclosure body 13 can be disassembled individually instead of disassembling them all when maintaining, such that it is can be maintained with a high flexibility and it is convenience for maintenance, and the cost thereof is low. On the edge of the LED display device 100, two first fixing holes 121 of the first fixing plate 120 respectively corresponds to two mounting holes 131 on two gathering corners of two enclosure bodies 13, and the first connection members 150 secure the two enclosure bodies 13 together. On the four corners of the LED display device 100, the first fixing hole 121 of the first fixing plate 120 merely corresponds to the mounting hole 131 of one enclosure body 13, and the first connection member 150 secures the enclosure body 13.

The installing pillar 110 is made of square steel and contacts the positions of two enclosure bodies 13 between two mounting holes 131 of the two enclosure bodies 13, thereby connecting multiple enclosure bodies 13 to the installing pillar 110. It can be understood that, the number of the installing pillars 110 can be more than three, the number of the first fixing plates 120 clamping and fixing the same installing pillar 110 can also be more than three, such that the enclosure bodies 13 can be fixed much steadier. The square steel has a regular shape, and contacts the enclosure bodies 13, facilitating for the first connection member 150 to secure the first fixing plates 130 and the enclosure bodies 13 to the installing pillars 110. The square steel is low cost and has a good mechanical strength. It can be understood that the installing pillar 110 can be an iron stand, a concrete pillar or other fixing frames.

Specifically, the first connection member 150 includes a screw 141 and a washer 152, the first fixing plate 120 and the enclosure body 13 is secured to the installing pillar 110 via the screw 151 and the washer 152. Therefore, it makes the installation much more convenient and practicable.

When assembly the LED display device 100, the installing pillar 110 rests against the rear surface of the enclosure module 130, and the first fixing plate 120 resists against the enclosure module 130. Then the first connection member 150 extends through the first fixing plate 120 and the enclosure body 13 in that order, securing the enclosure body 13 to the installing pillar 110. When maintaining, the enclosure body 13 is disassembled individually from the rear surface of the enclosure module 130, thus providing a rear surface maintenance structure suitable for installing on places such as the roof and so on, and providing maintenance with high flexibility, facilitating to operate and the cost thereof is low.

Figure 3:
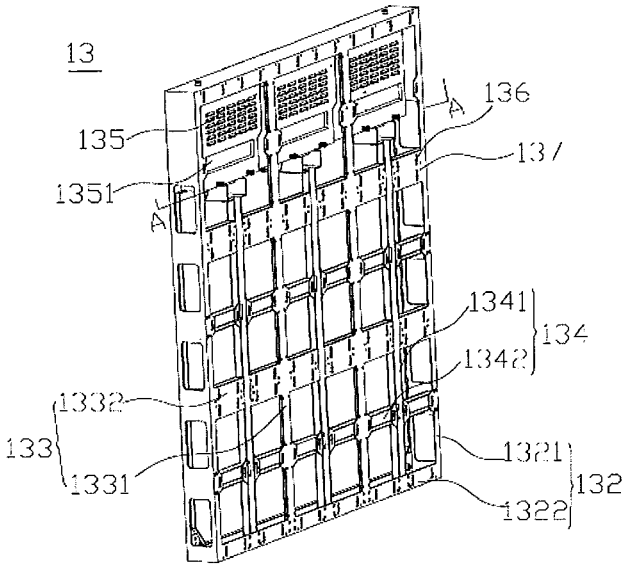
FIG. 3 is an isometric perspective view of an enclosure body of the LED display device of FIG. 1.

As shown in FIG. 3, the enclosure body 13 is in a frame shape, and includes a bounding frame 132, strip bars 133, wire-through grooves 134 and power supply mounting portions 135. The bounding frame 132 includes two side border frames 1321 on the opposite sides of the bounding frame 132, and two end border frames 1322 on opposite ends of the bounding frame 132. The strip bars 133 are substantially perpendicularly connected to a side of the bounding frame 132, and all the strip bars 132 are arranged in a same plane perpendicular to the bounding frame 132. Specifically, the strip bars 133 include longitudinal strip bars 1331 and horizontal strip bars 1332 perpendicular to the longitudinal strip bars 1332. The power supply mounting portions 135 are positioned on an end of the enclosure body 13. The power supply mounting portion 135 defines a slot 1351 for receiving a power supply.

The wire-through grooves 134 include longitudinal wire-through grooves 1341 and horizontal wire-through grooves 1342, the longitudinal wire-through grooves 1341 are fixedly connected to the horizontal strip bars 1332, an end of the longitudinal wire-through groove 1341 cuts through the slot 1351 and the other end of the longitudinal wire-through groove 1341 extends to the end border frame 1322 which is opposite to the power supply mounting portion 135 of the enclosure body 13. The horizontal wire-through grooves 1342 are fixedly connected to the longitudinal strip bars 1331, and cut through between the two side border frames 1321.

The longitudinal wire-through grooves 1341 and the horizontal wire-through grooves 1342 intersect with each other and are positioned in the bounding frame 132 of the enclosure body 13. The longitudinal wire-through grooves 1341 and the horizontal wire-through grooves 1342 form channels in intersecting portions of the longitudinal wire-through grooves 1341 and the horizontal wire-through grooves 1342. Because the wire-through grooves 134 and the strip bars 133 intersect and connect with each other in advance, when arranging wires, it merely needs to lay electric wires in the wire-through grooves 134 directly, thereby simplifying arranging wires. The slot 1351 is configured for receiving the power supply, and forms an integrated frame together with the wire-through grooves 134, the structure thereof is simple. Meanwhile, when maintaining, the LED display screen module 140 can be disassembled directly for inspecting and repairing the electric wires. It is simple and convenient.

In a specific embodiment, the longitudinal strip bars 1331 and the longitudinal wire-through grooves 1341 are parallel arranged and spaced from each other. The horizontal strip bars 1332 and the horizontal wire-through grooves 1342 are parallel arranged and spaced from each other. Each longitudinal wire-through groove 1341 cuts through the slot 1351. On one hand, such structure can realize an assembly of the LED display screen module 140, one the other hand, it facilitates to arrange electric wires, not only obtaining an attractive appearance and but also be convenient.

In an embodiment, the wire-through grooves 134 protrude from a same side of the bounding frame 132, and do not protrude from a plane where the strip bars positioned, such that a side of the bounding frame 132 of the enclosure body 13 forms a plane, facilitating to an arrangement of the LED display screen module 140.

The number of the strip bars 133 and the wire-through groove 134 are either one or more than three. Specifically, in the embodiment, the number of the longitudinal strip bars 1331 and the horizontal strip bars 1332 are both two, the longitudinal strip bars 1331 and the horizontal strip bars 1332 intersect with each other to form a frame, providing a support and fixation for the enclosure body 13. The number of the longitudinal wire-through grooves 1341 is three, and the number of the horizontal wire-through grooves 1342 is two, arranging wires on the enclosure body 13 is simple, assembly and maintenance thereof are simple. When assembly, securing with screws is eliminated, when maintaining, disassembling the screws is eliminated. Electric wires can extend through the wire-through groove 134 and connect with the power supply device received in the slot 1351. After the LED display screen module 140 assembled to the enclosure body 13, it is capable of protecting the electric wires in the wire-through groove 134 from damage such as being exposed to the blows and sunshine, the wire arranging mode is skilful and convenient, causing the enclosure body 13 to be more suitable for being installed outside.

Both the strip bars 133 and the wire-through groove 134 are provided with butterfly shaped slots 136 and positioning holes 137 for installing the LED display screen module 140. When maintaining, the LED display screen module 140 can be disassembled directly, it is simple and convenient for inspecting and repairing the wires. The intersecting portions of the end border frame 1322/the horizontal strip bar 1332 and the longitudinal wire-through grooves 1341/the longitudinal strip bars 1331 form the butterfly shaped slots 136 and the positioning holes 137, for securing a top portion and a bottom portion of the LED display screen module 140. The horizontal strip bar 1332 is provided with two rows of the butterfly shaped slots 136 to mount two adjacent LED display screen modules 140. The intersecting portions of the horizontal wire-through grooves 1342 and the side border frames 1321, or the longitudinal strip bars 1331 and the longitudinal wire-through grooves 1341 are also provided with the butterfly shaped slots 136 and the positioning holes 137, for securing a middle portion of the LED display screen module 140. Thereby, it facilitates to assembly a plurality of the LED display screen modules 140 to the enclosure body 13.

Figure 4:
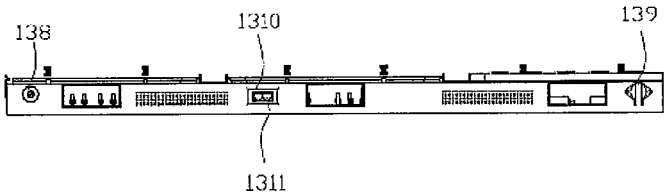
FIG. 4 is a structural view of an enclosure body of the LED display device of FIG. 1, viewed along line A-A.

As shown in FIG. 4, the enclosure body 13 further includes a power supply input port 138, a power supply output port 139, a data input port 1310 and a data output port 1311, and they are all located on a sidewall of the slot 1351 communicating with the longitudinal wire-through grooves 1341. The power supply input port 138 can be connected to an alternating current and capable of taking advantage of the alternating current to supply power. The power supply output port 139 can be connected to working equipment such as a display screen and so on, for supplying power. The data input port 1310 can be connected to a data input line which transmits data that needs to be displayed. The data output port 1311 can be connected to the working equipment for displaying the transferred data.

An LED display screen is further provided, the LED display screen includes above-described enclosure body 13 and a display module assembled to the enclosure body 13. Arranging wires on the enclosure body 13 is simple, assembly and maintenance thereof is simple. When mounting, securing with screws is eliminated, when maintaining, disassembling the screws is eliminated.

Figure 5:
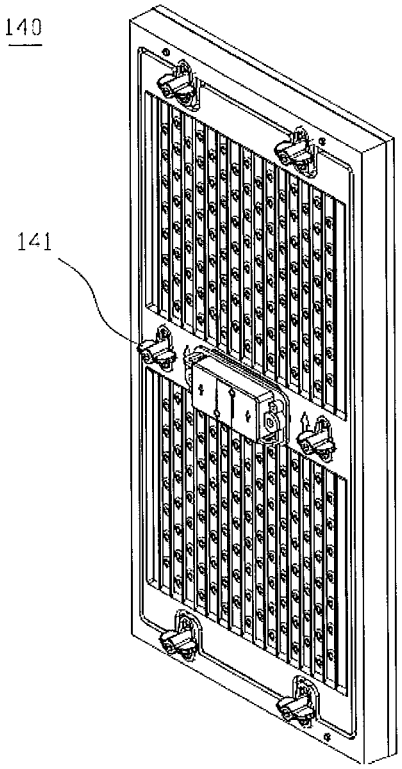
FIG. 5 is an isometric perspective view of an LED display module of the LED display device of FIG. 1.

The display module includes an LED display screen module 140. As shown in FIG. 5, the LED display screen module 140 is assembled to the frame formed by the end border frames 1322/the horizontal wire-through grooves 1332 and the longitudinal wire-through grooves 1341/the longitudinal strip bars 1331. Two adjacent LED display screen modules 140 are assembled to the butterfly shaped slots 136 defined on the horizontal strip bars 1332. The middle portion of the LED display screen module 140 is secured to the butterfly shaped slots 136 on the intersecting portions of the horizontal wire-through grooves 1342 and the longitudinal wire-through grooves 1341, and the intersecting portions of the longitudinal strip bars 1331 and the side bar frames 1321, Therefore, it facilitates to secure multiple LED display screen modules 140 to the enclosure body.

When the strip bar 133 and the wire-through grooves 134 are provided with the butterfly shaped slots 136 and the positioning holes 137, the LED display screen module 140 includes butterfly shaped hooks 141, the butterfly shaped hooks 141 are distributed on a top portion, a middle portion and bottom portion of the frame of the LED display screen module 140, through an engagement of the butterfly shaped hooks 141 and the butterfly shaped slots 136, the LED display screen module 140 is secured to the enclosure body 13. When maintaining, the LED display screen module 140 can be disassembled directly, thereby facilitating to inspect and repair the wires. It is simple and convenient. Specifically, in the embodiment, the number of the butterfly shaped hooks 141 is six, every two are located on the top portion, middle portion and bottom portion of the rear surface frame of the LED display screen module 140.

Figure 6:
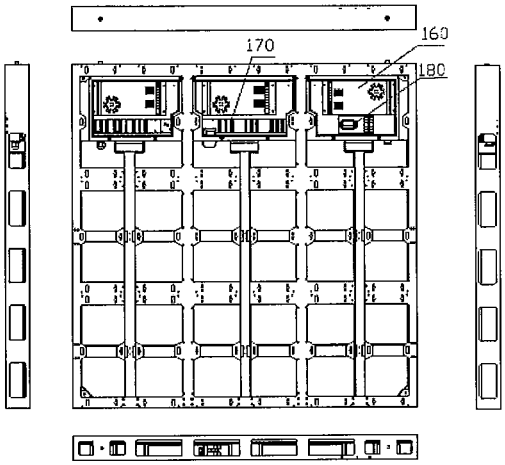
FIG. 6 is a structural view of the LED display device of FIG. 1 in a flat developed state.

As shown in FIG. 6, the display module includes a power supply device 160, a HUB board 170 and a filter 180. The power supply device 160 is mounted within the slot 1351. The HUB board 170 and the filter 180 are both located in the power box 162. The HUB board 170 is connected to the LED display screen module 140 for extending controller card. The filter 180 is connected to the power supply device 160 to filter an electromagnetic interference, thereby obtaining a stable power signal and avoiding a severe electromagnetic interference which affects a normal work of the radio waves outdoors.

Figure 7:
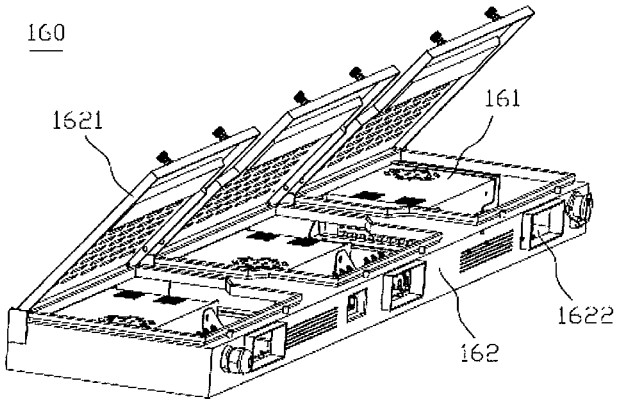
FIG. 7 is an isometric perspective view of a power supply device of the LED display device of FIG. 1.

As shown in FIG. 7, the power supply device 160 includes a power supply 161 and a power box 162. The power supply 161 is mounted within the power box 162, it is safe and has an attractive appearance. The power box 162 includes a cover 1621 capable of being open and close. The number of the power supply 161 is more than three, accordingly, the number of the covers 1621 of the power box 162 is also more than three. In a specific embodiment, the power box 162 includes three covers 1621 each covering one power supply 161. It can be understood that, the number of the power supplies 161 is not limited to three, it can also be one or more than three, and accordingly, the number of the covers 1621 can also be one or more than three. If the power box 162 adopts a conventional one-piece cover 1621, portions of the longitudinal strip bar adjacent to the power box will inevitably block the cover, causing the cover cannot be closed or opened. In the present INVENTION, the cover 1621 of the power box 162 is independent and the number thereof is corresponding to that of the power supply 161, the cover 1621 is not blocked by the longitudinal strip bar 1311, and further obtains an attractive appearance and is practicable.

A side surface of the power box 162 facing the LED display screen module 140 defines a wire entrance hole 1622 communicating with the wire-through grooves 134. The number of the wire entrance holes 1622 is corresponding to that of the power supplies 161, facilitating to connect the electric wires within the wire-through grooves 134 to the power supply 161. A rear cover of the power box 162 defines a plurality of heat dissipation openings, facilitating to a heat dissipation of the devices such as the power supply 161 and so on.

Figure 8:
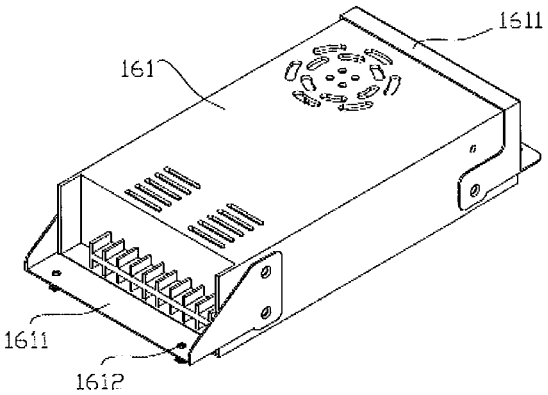
FIG. 8 is an isometric perspective view of a power supply of the LED display device of FIG. 1.

As shown in FIG. 8. the power supply 161 is equipped with a pressing bar 1611, an end of the pressing bar 1611 is secured to the power box 162. Specifically, in the embodiment, opposite ends of the power supply 161 are provided with pressing bars 1611 which are secured to the power box 162 via screws 1612. When maintain, unscrewing the screw 1612 is merely required to disassemble the power supply 161, thereby saving a maintenance time.

When installing the display screen module, after the display module is assembled to the enclosure body 13, the electric wires in the data enclosure extend through the side surface of the enclosure body 13 and enter into the wire-through grooves 134. Then the electric wires enter into the power box 162 through the wire entrance holes 1622 and connect with the power supply 161. Thereby, the electric wires in the wire-through grooves 134 can be protected from being exposed to the blows and sunshine and so on, the wire arranging method is skilful and convenient, causing the enclosure body 13 to be more suitable for being installed outside.

The LED display screen module 140 is provided with butterfly shaped hooks 141, the LED display screen is secured to the enclosure body 13 via an engagement of the butterfly shaped hooks 141 and the butterfly shaped slots 136. The LED display screen module 140 can be removed from a front of the enclosure body 13 individually, facilitating to maintenance, it is not necessary to remove the enclosure body 13 first and then disassemble the LED display screen module 140, such that a maintenance time is reduced.

Figure 9:
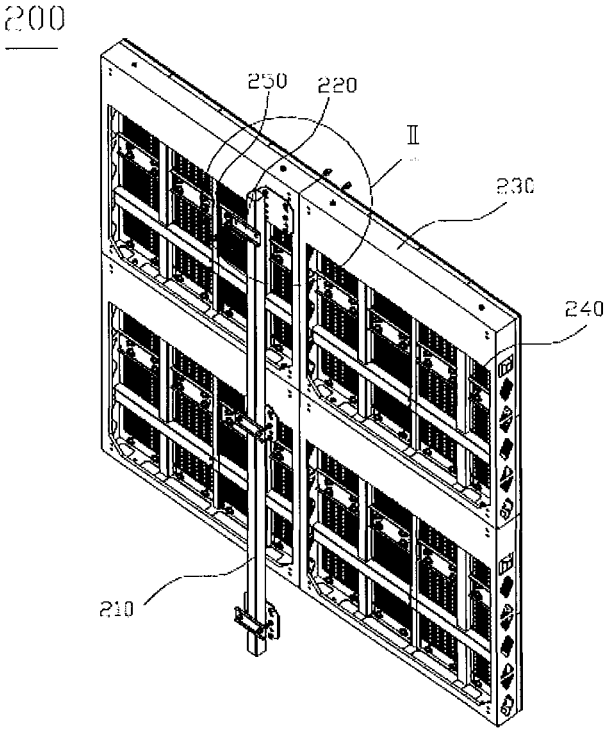
FIG. 9 is an isometric perspective view of an LED display device according to another embodiment of the present INVENTION.
Figure 10:
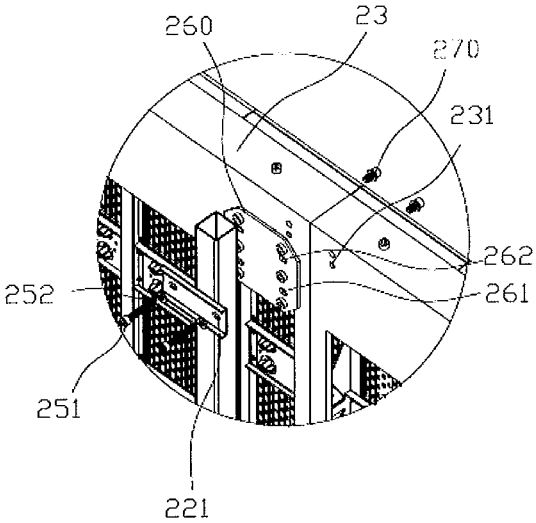
FIG. 10 is a partial enlarged view of portion II of the LED display device of FIG. 9.

With reference to FIG. 9 and FIG. 10, an LED display device 200 according to another embodiment, includes an installing pillar 210, a first fixing plate 220, an enclosure module 230, an LED display screen module 240 and a first connection member 250. The installing pillar 210 is positioned on a rear surface of the enclosure module 230. The first fixing plate 220 closely contacts the installing pillar 210, and defines a first fixing hole 221 thereon. The enclosure module 230 defines a mounting hole 231 hereon.

The enclosure module 230 includes enclosure bodies 23. Specifically, the enclosure body 23 defines mounting holes 231 hereon. The enclosure module 230 includes a plurality of enclosure bodies 23.

The difference between the embodiment and the LED display device 100 according to the first embodiment is that, the enclosure module 230 further includes a second fixing plate 260 and second connection members 270. The second fixing plate 260 defines second fixing holes 261 thereon. The second fixing plate 260 is positioned at a rear surface of the enclosure module 230, and located between the installing pillar 210 and the enclosure body 23. The second connection member 270 extends through the mounting hole 231 and the second fixing hole 261 in that order from a front surface of the enclosure module 230, thereby connecting the second fixing plate 260 to the enclosure body 23. The second fixing plate 260 further defines third fixing holes 262. The first connection member 250 extends through the first fixing hole 221 and the third fixing hole 262 in that order from the rear surface of the enclosure module 230, thereby connecting the first fixing plate 220 to the enclosure module 230.

In this embodiment, the number of the first fixing hole 221 is two, and the number of the third fixing hole 262 is two.

Each of the first connection member 250 and the second connection member 270 includes a screw 251 and a washer 252, the screw 251 is fixed to the washer 252, and thereby it is simple, convenient and practical.

More specifically, a plurality of enclosure bodies 13 are distributed on a plane, and arranged in a lattice array configuration. The second fixing plate 260 defines four of the second fixing holes 261 thereon. On adjacent portions of four enclosure bodies 23, the four second fixing holes 261 respectively corresponds to four mounting holes 231 of every four enclosure bodies 23, the four mounting holes 231 are located on the four gathering corners of the four enclosure bodies 23. On an edge of the LED display device 200, the second fixing holes 261 of the second fixing plate 260 respectively corresponds to the mounting holes 231 of two enclosure bodies 23. The second connection members 270 extends through the second fixing hole and the mounting hole to secure two of the enclosure bodies 23 together. On four corner of the LED display device 200, the second fixing hole 261 of the second fixing plate 260 corresponds to the mounting hole 231 of one enclosure body 23, and the second connection member 270 extends through the second fixing hole and the mounting hole to secure an enclosure body 23.

When install the LED display device 200, the second connection member 270 is screwed into the front surface of the enclosure module 230 and is fixed to the second fixing plate 260, securing the enclosure body 23. The first connection member 250 is screwed into the enclosure body 23 from the rear surface of the enclosure module 230, clamping and securing the first fixing plate 220, the installing pillar 210 and the second fixing plate 260 to realize an assembly of the LED display device 200. When maintaining, the enclosure body 23 is disassembled from the second fixing plate 260 from the front surface of the enclosure module 230, a simultaneously disassembly of other enclosure bodies 23 is omitted.

The LED display device 200 provides a front-maintenance structure, which can be disassembled from a front side of the LED display device 200 when the LED display device 200 leans against a wall or hung on a wall, thereby realizing a front surface wires-arrangement, adjustment and maintenance, and reducing a working difficulty and saving labor. In addition, the enclosure body 13 can be disassembled individually instead of disassembling them all when maintaining, such that it is can be maintained with a high flexibility and it is convenience for operation, and the cost thereof is low. Moreover, space of a rear surface and a side surface is not occupied, thereby saving a maintenance space.

Although the present INVENTION is illustrated and described herein with reference to specific embodiments, the present INVENTION is not intended to be limited to the details shown. Rather, various modifications may be made in the details within the scope and range of equivalents of the claims and without departing from the present INVENTION.

What is claimed is:

1. An LED display device, comprising: an installing pillar, a first fixing plate, an enclosure module, an LED display screen module and a first connection member, the enclosure module comprising a front surface for display, and a rear surface opposite to the front surface, and a plurality of enclosure bodies, the plurality of enclosure bodies are distributed on a plane and arranged in a lattice array configuration, each enclosure body defines four mounting holes on four corners thereof, the installing pillar being positioned on the rear surface of the enclosure module, the first fixing plate closely contacting the installing pillar, the first fixing plate defining four first fixing holes, the first connection member extending through the first fixing hole and the mounting hole in that order from the rear surface of the enclosure module and connecting with the enclosure module, thereby clamping and securing the installing pillar between the first fixing plate and the enclosure module, and the enclosure module being fixed to the installing pillar via the first fixing plate and the first connection member, on adjacent portions of four enclosure bodies, the four first fixing holes of the first fixing plate respectively corresponds to four mounting holes of every four enclosure bodies, the four mounting holes are located on four gathering corners of the four enclosure bodies, the first connection member secures every four enclosure bodies, the LED display screen module being assembled to the front surface of the enclosure module.

2. The LED display device of claim 1, wherein the enclosure body comprises a bounding frame, strip bars, power supply mounting portions, and wire-through grooves, the bounding frame comprises two side border frames on the opposite sides thereof, and two end border frames on opposite ends thereof, the strip bars comprise longitudinal strip bars and horizontal strip bars perpendicular to the longitudinal strip bars, the longitudinal strip bars connect with a side of the bounding frame and are substantially perpendicular to the bounding frame; the power supply mounting portions are positioned on an end of the enclosure body, and the power supply mounting portion defines a slot for receiving a power supply; the wire-through grooves comprises longitudinal wire-through grooves and horizontal wire-through grooves, the longitudinal wire-through groove is fixedly connected to the horizontal strip bar, an end of the wire-through groove cuts through the slot and the other end of the wire-through groove extends to one end border frame on an end of the bounding frame opposite to the power supply mounting portion, the horizontal wire-through grooves are fixedly connected to the longitudinal strip bars, and the horizontal wire-through groove extends between the two side border frames on opposite sides, the longitudinal wire-through grooves and the horizontal wire-through grooves intersect with each other and are poisoned in the bounding frame of the enclosure body, and form channels in intersecting portions of the longitudinal wire-through grooves and the horizontal wire-through grooves.

3. The LED display device of claim 2, wherein the longitudinal strip bars and the longitudinal wire-through grooves are parallel arranged and spaced from each other, the horizontal strip bars and the horizontal wire-through grooves are parallel arranged and spaced from each other, every longitudinal wire-through groove cuts through the slot.

4. The LED display device of claim 2, wherein all of the strip bars are arranged in a plane perpendicular to the bounding frame, the wire-through grooves protrude from a same side of the bounding frame, and do not protrude from the plane where the strip bars positioned upon.

5. The LED display device of claim 2, wherein both of the strip bar and the wire-through groove define a butterfly shaped slot and a positioning hole, the LED display screen module is provided with butterfly shaped hooks, the LED display screen module is secured to the enclosure body via an engagement of the butterfly shaped hooks and the butterfly shaped slots.

6. An LED display device, comprising: an installing pillar, a first fixing plate, a second fixing plate, an enclosure module, an LED display screen module, a first connection member and a second connection member, the enclosure module comprising a front surface for display, a rear surface opposite to the front surface, and an enclosure body defining a mounting hole, the installing pillar being positioned on the rear surface of the enclosure module, the first fixing plate closely contacting the installing pillar, the second fixing plate defines a second fixing hole and a third fixing hole, the second fixing plate is located at the rear surface of the enclosure module and positioned between the installing pillar and the enclosure body, the second connection member extends through the mounting hole and the second fixing hole in that order from the front surface of the enclosure module, thereby connecting the second fixing plate to the enclosure body, the first fixing plate defining a first fixing hole, the first connection member extending through the first fixing hole and the third fixing hole in that order from the rear surface of the enclosure module and connecting with the enclosure module, thereby clamping and securing the installing pillar between the first fixing plate and the enclosure module, and the enclosure module being fixed to the installing pillar via the first fixing plate and the first connection member, the LED display screen module being assembled to the front surface of the enclosure module.

7. An LED display device, comprising: an installing pillar, a first fixing plate, a second fixing plate , an enclosure module, an LED display screen module, a first connection member and a second connection member, the enclosure module comprising a front surface for display, a rear surface opposite to the front surface, and a plurality of enclosure bodies distributed on a plane and arranged in a lattice array configuration, the installing pillar being positioned on the rear surface of the enclosure module, the first fixing plate closely contacting the installing pillar, the first fixing plate defining a first fixing hole, the first connection member extending through the first fixing hole from the rear surface of the enclosure module and connecting with the enclosure module, thereby clamping and securing the installing pillar between the first fixing plate and the enclosure module, and the enclosure module being fixed to the installing pillar via the first fixing plate and the first connection member, the second fixing plate defines four second fixing holes thereon, the second fixing plate is located at the rear surface of the enclosure module and positioned between the installing pillar and the enclosure body, the second connection member extends through the mounting hole and the second fixing hole in that order from the front surface of the enclosure module, thereby connecting the second fixing plate to the enclosure body, on adjacent portions of four enclosure bodies, the four second fixing holes respectively corresponds to four mounting holes of every four enclosure bodies, the four mounting holes are located on four gathering corners of the four enclosure bodies, the second connection member secures every four enclosure bodies, the LED display screen module being assembled to the front surface of the enclosure module.

* * * * *